US009271585B1

(12) United States Patent
Chung

(10) Patent No.: US 9,271,585 B1
(45) Date of Patent: Mar. 1, 2016

(54) HANGING SUNGLASS HOLDER SYSTEM

(71) Applicant: Elizabeth Vanessa Chung, Queens, NY (US)

(72) Inventor: Elizabeth Vanessa Chung, Queens, NY (US)

( * ) Notice: Subject to any disclaimer, the term of this patent is extended or adjusted under 35 U.S.C. 154(b) by 112 days.

(21) Appl. No.: 14/192,479

(22) Filed: Feb. 27, 2014

Related U.S. Application Data

(60) Provisional application No. 61/769,825, filed on Feb. 27, 2013.

(51) Int. Cl.

| | |
|---|---|
| ***A47F 7/02*** | (2006.01) |
| ***A47F 5/08*** | (2006.01) |
| ***A47F 5/00*** | (2006.01) |
| ***A47B 43/04*** | (2006.01) |

(52) U.S. Cl.

CPC ..... *A47F 7/021* (2013.01); *A47B 43/04* (2013.01); *A47F 5/0006* (2013.01); *A47F 5/08* (2013.01); *A47F 5/0884* (2013.01)

(58) Field of Classification Search

CPC ..... A47F 7/021; A47F 7/02; A47F 7/024; A47F 7/0243; A47F 7/00; A47F 7/12; A47F 7/14; A47F 7/143; A47F 7/16; A47F 7/19; A47F 7/022; A47F 5/0006; A47F 5/08; A47F 5/0884; A47F 5/00; A47F 2005/0012; A47F 5/0807; A47B 43/04; A47B 47/06; A47B 61/06; A47B 61/003; A47G 25/74; A47G 25/746

USPC ..... 211/85.1, 85.2, 85.3, 13, 119.004, 211/119.009; 206/5; 248/902; D6/28, 85

See application file for complete search history.

(56) References Cited

U.S. PATENT DOCUMENTS

| | | | | | |
|---|---|---|---|---|---|
| 358,193 | A * | 2/1887 | Gause | 248/114 |
| 2,767,895 | A * | 10/1956 | Smith | 224/275 |
| 3,642,143 | A * | 2/1972 | Cass | 211/85.3 |
| 3,782,558 | A * | 1/1974 | Schael, Jr. | 211/13.1 |
| 3,858,726 | A * | 1/1975 | Rosenwein | 211/85.1 |
| 4,204,602 | A | 5/1980 | Dunchock | |
| 4,723,666 | A | 2/1988 | Nichols | |
| 4,746,009 | A * | 5/1988 | Liberman | 206/723 |
| 4,953,765 | A * | 9/1990 | Little et al. | 224/583 |
| 5,011,027 | A * | 4/1991 | Van Slett | 211/85.1 |
| 5,253,750 | A * | 10/1993 | Keffer | 206/6.1 |
| 5,427,230 | A * | 6/1995 | Mattox | 206/6.1 |
| 5,551,772 | A * | 9/1996 | Keffer | 312/114 |
| 5,568,872 | A * | 10/1996 | Hinnant, Sr. | 211/85.1 |
| 5,699,990 | A * | 12/1997 | Seach | 248/309.1 |
| 5,931,319 | A * | 8/1999 | Murphy | 211/85.2 |
| 7,389,868 | B2 * | 6/2008 | Lewand et al. | 206/6.1 |
| 7,712,641 | B2 * | 5/2010 | Snyder | 223/88 |
| 8,181,775 | B2 * | 5/2012 | Bunn | 206/315.1 |
| 8,348,054 | B2 * | 1/2013 | Dragan | 206/292 |
| 8,657,124 | B2 * | 2/2014 | Brown | 211/34 |
| 8,783,475 | B2 * | 7/2014 | Carver et al. | 211/113 |
| 2002/0005389 | A1 * | 1/2002 | Guo | 211/85.3 |
| 2004/0184268 | A1 * | 9/2004 | Maxwell et al. | 362/257 |
| 2005/0173268 | A1 * | 8/2005 | Boyette | 206/5 |
| 2005/0232519 | A1 * | 10/2005 | Grimes | 383/39 |
| 2007/0193969 | A1 * | 8/2007 | Albanese | 211/85.2 |
| 2012/0118923 | A1 * | 5/2012 | Allen | 224/191 |
| 2014/0263116 | A1 * | 9/2014 | Wojciechowski | 211/85.2 |
| 2015/0068993 | A1 * | 3/2015 | Ye | 211/85.2 |

* cited by examiner

*Primary Examiner* — Jennifer E Novosad

(74) *Attorney, Agent, or Firm* — RG Patent Consulting, LLC; Rachel Gilboy

(57) ABSTRACT

An apparatus for organizing and storing many pairs of sunglasses conveniently. The hanging sunglass holder is a hanging, fabric panel equipped with a series of vertically stepped, horizontally drawn cords or strings upon which multiple pairs of sunglasses, folded, and flat could be hung by their temples. The fabric panel, able to be rolled up for storage when not in use, serves not only as a safe and secure apparatus for storing sunglasses, but also as an attractive, tapestry-like, individualized wall-hanging in its own right.

12 Claims, 7 Drawing Sheets

HANGING SUNGLASS HOLDER SYSTEM

CROSS-REFERENCE TO RELATED APPLICATION

The present application is related to and claims priority from prior provisional application Ser. No. 61/769,825, filed Feb. 27, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of storage and more specifically relates to a hanging sunglass holder system entitled Hanging Sunglasses Line.

2. Description of the Related Art

Sunglasses are a form of protective eyewear designed primarily to prevent bright sunlight and high-energy visible light from damaging or discomforting the eyes. They can sometimes also function as a visual aid, as variously termed spectacles or glasses exist, featuring lenses that are colored, polarized or darkened. Healthcare professionals recommend eye protection whenever the sun comes out to protect the eyes from ultraviolet radiation and blue light, which can cause several serious eye problems. Its usage is mandatory immediately after some surgical procedures such as IntroLASIC and recommended for a certain time period in dusty areas, when leaving the house and in front of a TV screen or computer monitor after LASEK.

Sunglasses have long been associated with celebrities and film actors primarily from a desire to mask their identity. Since the 1940's sunglasses have been popular as a fashion accessory, especially on the beach. Many users have several pairs of sunglasses in order to set a variety of 'fashions tones'. The trouble with having several pairs of sunglasses, as many consumers do, is finding a sufficiently safe, sufficiently ample space in which to organize and store them. It is desirable to have sunglasses accessible, yet protected from potential damage during storage. An efficient, effective, a reasonably priced means for storing sunglasses is desirable.

Various attempts have been made to solve the above-mentioned problems such as those found in U.S. Pat. No. 3,858,726 to David Rosenwein, U.S. Pat. No. 4,723,666 to David G. Nichols, and U.S. Pat. No. 4,204,602 to Richard S. Dunchock. This art is representative of storage. None of the above inventions and patents, taken either singly or in combination, is seen to describe the invention as claimed.

Ideally, a hanging sunglass holder system should provide sufficient storage space for many pairs of sunglasses that is easily accessible while protecting sunglasses from damage during storage and, yet would operate reliably and be manufactured at a modest expense. Thus, a need exists for a reliable hanging sunglass holder system to avoid the above-mentioned problems.

BRIEF SUMMARY OF THE INVENTION

In view of the foregoing disadvantages inherent in the known storage art, the present invention provides a novel hanging sunglass holder system entitled Hanging Sunglasses Line. The general purpose of the present invention, which will be described subsequently in greater detail is to provide a storage space for many pairs of sunglasses that is easily accessed while protecting sunglasses from damage during storage.

A hanging-sunglass-holder-system is disclosed herein, in a preferred embodiment, comprising: a hanging-sunglass-holder-assembly which comprises in combination a panel having a front-side and a rear-side, a hanging-cord having a hanging-cord-first-end and a hanging-cord-second-end, a plurality of cross-cords, each of the cross-cords having a cross-cord-first-end and a cross-cord-second-end, a plurality of sheaths fixedly attached to the rear-side of the panel, each of the sheaths having a sheath-volume, a closed-end and an open-end, and a plurality of support-slats. The panel having a front-side and a rear-side comprises in combination a left-trim, a right-trim, a pair of top-eyelets, and a plurality of pair-of-cord-eyelets.

The panel having a front-side and a rear-side comprised of fabric material measures approximately 41½ inches in height and approximately 11½ inches in width in preferred embodiments, such that is suitably sized to be functional and aesthetically pleasing when displayed. The front-side of the panel and the rear-side of the panel comprise a left-trim of about ½ inch and a right-trim of about ½ inch comprising fabric located on a left-edge and a right-edge of the panel in a vertical alignment and fixedly attached via stitching to the front-side and the rear-side of the panel.

The front-side of the panel comprises a pair of top-eyelets extending through the panel and a plurality of pair-of-cord-eyelets also extending through the panel. The pair of top-eyelets are located close to a top-edge of the panel and each of the pair of top-eyelets are an equal distance from the left-trim and the right-trim with the pair of top-eyelets having a horizontal alignment. The plurality of pair-of-cord-eyelets comprises exactly six of the pair-of-cord-eyelets in this particular embodiment. Each of the pair-of-cord-eyelets comprises a cord-left-eyelet and a cord-right-eyelet having a horizontal orientation to each other on the panel. Each of the cord-left-eyelets are located relatively close to an inside-edge of the left-trim and each of the cord-right-eyelets are located relatively close to an inside-edge of the right-trim. Each of the pair-of-cord-eyelets are arranged with a vertical distance of about seven inches from each other.

The hanging-cord is useful for suspending the hanging-sunglass-holder-assembly on a planer surface such as a wall or the like. The hanging-cord-first-end and the hanging-cord-second-end are threaded through the pair of top-eyelets and through a pair of top-support-slat-eyelets on a top-support-slat and knotted behind the top-support-slat. The top-support-slat provides horizontal stabilization for the top edge of the panel. The hanging-cord is of sufficient length to be looped and be removably placed on a hanger-apparatus able to be used with the planer surface comprising a wall.

The plurality of cross-cords (useful for suspending a plurality of sunglasses on the panel) preferably comprise exactly six of the cross-cords with each of the cross-cords having a cross-cord-first-end and a cross-cord-second-end. Each of the cross-cords is of sufficient length to be threaded through each of the cord-left-eyelets and the horizontally opposing cord-right-eyelets with the cross-cord-first-end and the cross-cord-second-end fixedly attached to the rear-side of the panel. Each of the cross-cords is able to hold up to six pairs of sunglasses (each) folded 'flat' and (each) suspended by a temple of the sunglasses.

The plurality of sheaths, constructed of fabric, are fixedly attached to the rear-side of the panel via stitching. They are useful for holding the plurality of support-slats. Each of the sheaths has a sheath-volume, a closed-end and an open-end comprising exactly six of the sheaths and a plurality of support-slats comprising exactly six of the support-slats. Each of the plurality of sheaths are horizontally aligned on the rear-side of the panel such that each of the sheaths is lined up with each of the pair-of-cord-eyelets. Each of the sheath-volumes is of sufficient size to contain one of the support-slats preferably comprising wooden material measuring about 11½ inches long, ½ inch high and deep. The closed-end restricts the support-slats from slipping through the sheaths as they are inserted. The support-slats when inserted into the sheaths via the open-end provide vertical and lateral support for the panel.

When in use, a user is able to insert the plurality of support-slats into the plurality of sheaths via the open-end of each sheath, attach a hanging-cord, and removably suspend the hanging-sunglass-holder-assembly on the planer surface via the hanging-cord being placed upon a hanging-apparatus. The user can then place a plurality of sunglasses on each of the cross-cords as desired. The present invention is functional in its intended purpose and aesthetically pleasing.

A kit is included for the hanging sunglass holder system including a panel, an attached hanging-cord, a plurality of attached cross-cords, a plurality of support-slats, and a set of user instructions. A method of use for the hanging sunglass holder system is also disclosed herein.

The present invention holds significant improvements and serves as a hanging sunglass holder system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, hanging sunglass holder system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to storage and more particularly to a hanging sunglass holder system as used to improve the ability to store many pairs of sunglasses in an efficient manner permitting a user to arrange them is a desired positioning and having them visible such that the user can easily select a desired pair of sunglasses for use.

Generally speaking, the hanging sunglass holder system provides an apparatus for organizing and storing many pairs of sunglasses conveniently. The hanging sunglass holder is a hanging, fabric panel equipped with a series of vertically stepped, horizontally drawn cords or strings upon which multiple pairs of sunglasses, folded, and flat may be hung by their temples. The fabric panel, able to be rolled up for storage when not in use, serves not only as a safe and secure means for storing sunglasses, but also as an attractive, tapestry-like, individualized wall-hanging in its own right. By suspending the hanging sunglass holder system on a wall, a closet door or another planer surface, a user is able to see all of the stored sunglasses at a glance since they are all suspended on cross cords. The hanging sunglass holder system stores up to 36 pairs of sunglasses, suspended by their temple, using a plurality of cross cords. The hanging sunglass holder system may include a variety of artwork, designs, and indicia as desired.

Figure 1:
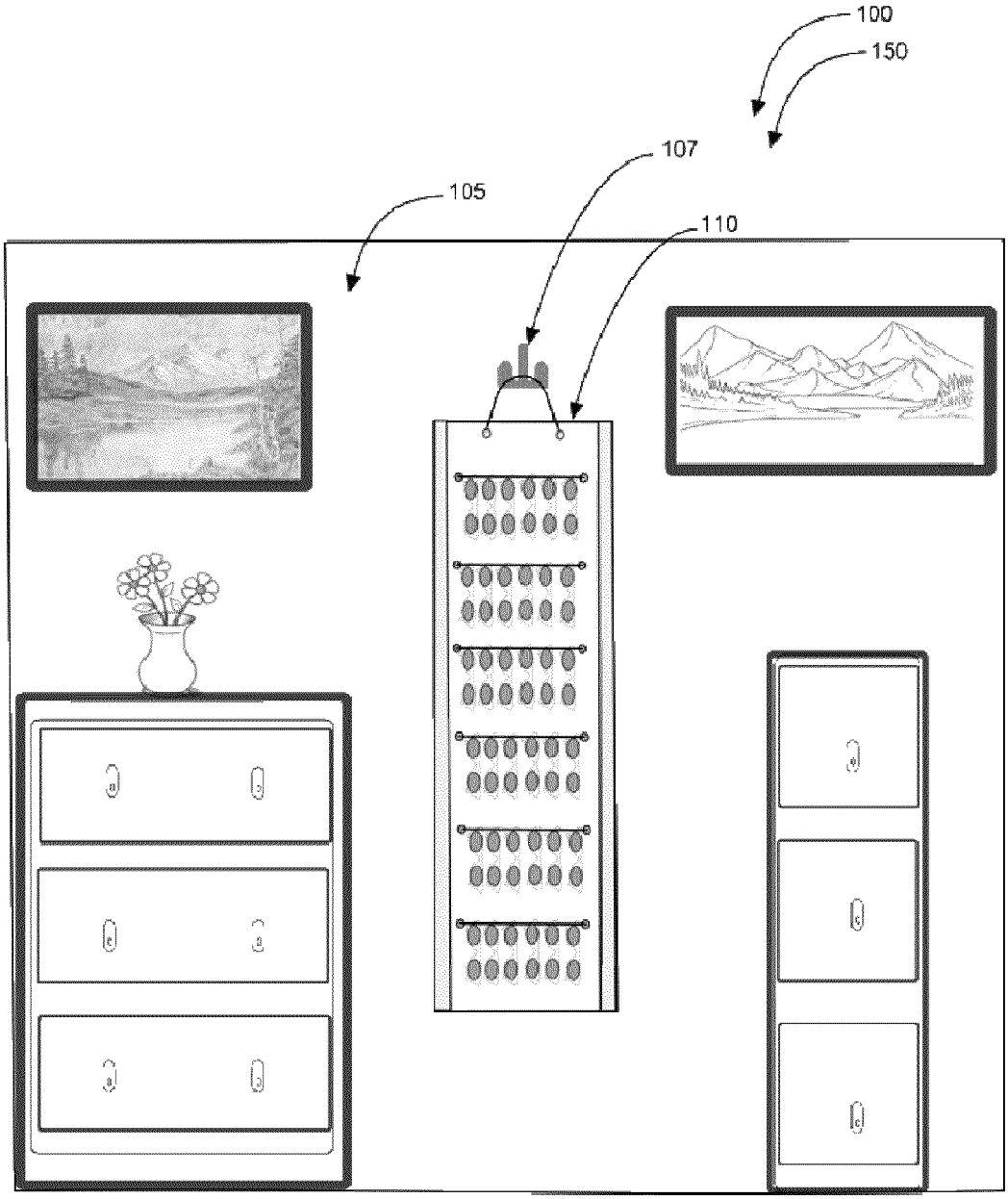
FIG. 1 shows a perspective view illustrating a hanging sunglass holder system in an in-use condition (as displayed on a wall) according to an embodiment of the present invention.

Referring to the drawings by numerals of reference there is shown in FIG. 1, a perspective view illustrating hanging sunglass holder system 100 in an in-use condition 150 according to an embodiment of the present invention.

Hanging-sunglass-holder-system 100 comprises hanging-sunglass-holder-assembly 110 which comprises in combination panel 115 having front-side 120 and rear-side 140, hanging-cord 160 (having hanging-cord-first-end 162 and hanging-cord-second-end 164), plurality of cross-cords 170 (each of cross-cords 170 having cross-cord-first-end 172 and cross-cord-second-end 174), plurality of sheaths 180 fixedly attached to rear-side 140 of panel 115 (each of sheaths 180 having sheath-volume 182, closed-end 184 and open-end 186), and a plurality of support-slats 190. Panel 115 having front-side 120 and rear-side 140 comprises in combination left-trim 122, right-trim 124, pair of top-eyelets 126, and plurality of pair-of-cord-eyelets 128. In a preferred embodiment the plurality of support-slats 190 comprises exactly six support-slats 190 for insertion into plurality of sheaths 180 and top-support-slat 192 useful for maintaining overall horizontal support for panel 115.

When in use, a user is able to insert plurality of support-slats 190 into plurality of sheaths 180 via open-end 186 of each sheath 180, attach hanging-cord 160 and removably suspend hanging-sunglass-holder-assembly 110 on planer surface 105 via hanging-cord 160 being placed upon hanging-apparatus 107. The user can then place plurality of sunglasses 109 on each of cross-cords 170 as desired, as indicated in various drawings.

Figure 2:
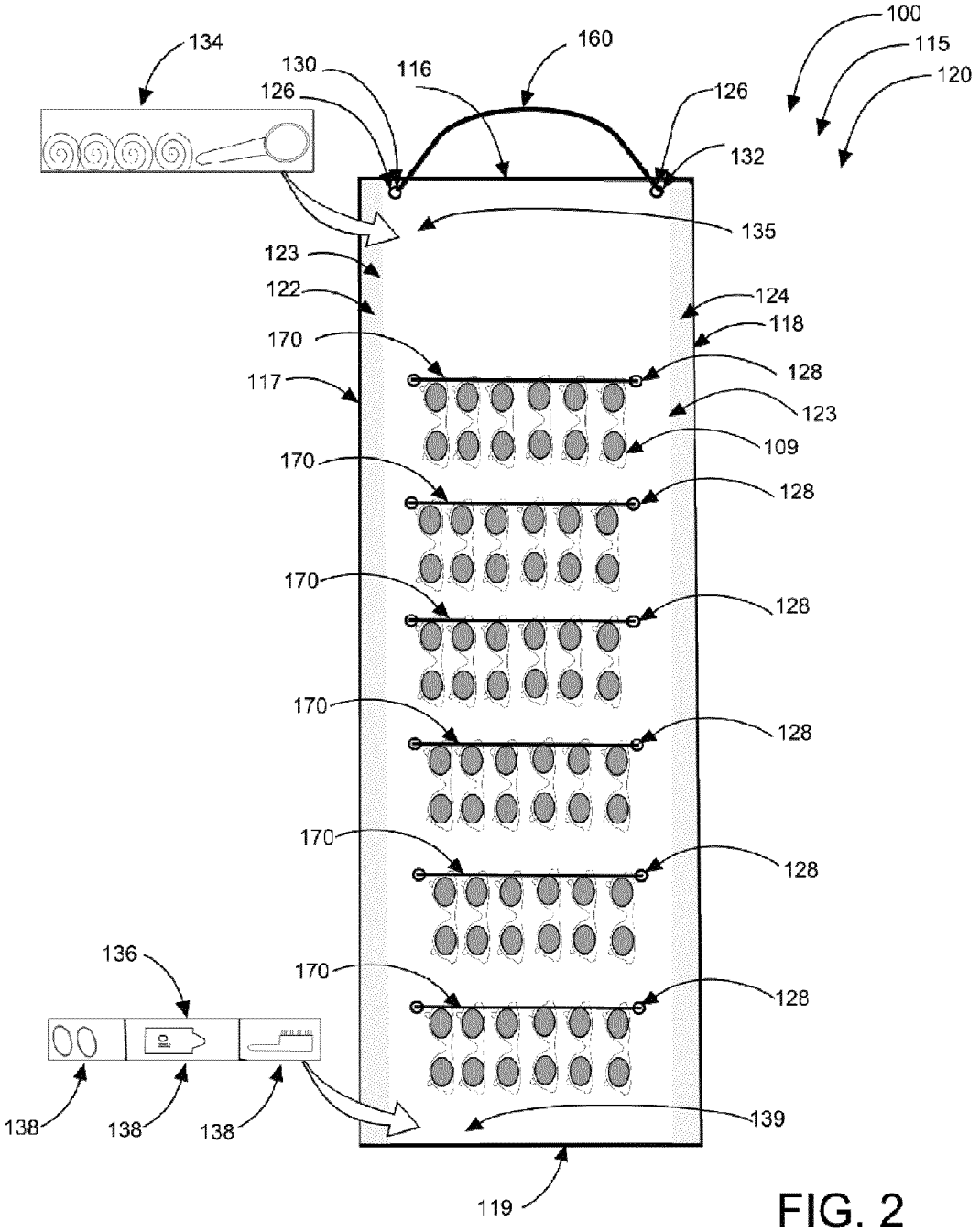
FIG. 2 is a perspective view illustrating a front-side of panel according to an embodiment of the present invention of FIG. 1.

Referring now to FIG. 2, a perspective view illustrating front-side 120 of panel 115 according to an embodiment of the present invention of FIG. 1.

Panel 115 having front-side 120 and rear-side 140 comprised of fabric material may measure approximately 41½ inches in height and approximately 11½ inches in width. The fabric material may be fabricated in any number of colors, textures, finishes, and graphic patterns. If desired, personalized indicia may be included on front-side 120 such as "Get Your Swing On" and "Rock Star" and "Queen of Fashion" and other messages indicating the personality of the user. This creates aesthetic appeal for the present invention.

Front-side 120 of panel 115 and rear-side 140 of panel 115 comprise left-trim 122 and right-trim 124 comprising fabric located on left-edge 117 and right-edge 118 of panel 115 in a vertical alignment and fixedly attached preferably via stitching to front-side 120 and rear-side 140 of panel 115. Panel 115 (having front-side 120 and rear-side 140) comprises a continuous length of fabric in any of a variety of colors, textures, finishes, and graphic patterns. Left-trim 122 and right-trim 124 measuring approximately ½ inch wide comprises material selected from the group consisting of silk, satin, and patterned border fabric. Other materials may be used.

Front-side 120 of panel 115 comprises pair of top-eyelets 126 extending through panel 115 and plurality of pair-of-cord-eyelets 128 also extending through panel 115. Pair of top-eyelets 128 are located close to top-edge 116 of panel 115 and each of pair of top-eyelets 126 are an equal distance from left-trim 122 and right-trim 124 with pair of top-eyelets 126 having a horizontal alignment with each other. Plurality of pair-of-cord-eyelets 128 comprises exactly six of pair-of-cord-eyelets 128. Each of pair-of-cord-eyelets 128 comprises cord-left-eyelet 130 and cord-right-eyelet 132 having a horizontal orientation to each other on panel 115. Each of cord-left-eyelets 128 are located relatively close to inside-edge 123 of left-trim 122 and each of cord-right-eyelets 132 are located relatively close to inside-edge 123 of right-trim 124. Each of pair-of-cord-eyelets 128 are arranged with a vertical distance of about seven inches from each other.

Front-side 120 of panel 115 may further comprise top-storage-pocket-with-volume 134 on top-margin 135 of front-side 120 extending from left-trim 122 to right-trim 124 and divided-bottom-storage-pocket 136 on bottom-margin 139 of front-side 120 extending from left-trim 122 to right-trim 124. Top-storage-pocket-with-volume 134 comprising clear acrylic material is a single storage area which may be used for storing items such as a mirror, an eyeglass repair kit and extra cross-cords as desired. In alternate embodiments top-storage-pocket-with-volume 134 may comprise fabric material in any number of colors, textures, finishes, and graphic patterns. Divided-bottom-storage-pocket 136 made of fabric material comprises three individual-pockets 138 separated by stitching with each of individual-pockets 138 having a volume useful for containing miscellaneous items as desired. In alternate embodiments divided-bottom-storage-pocket 136 may comprise fabric material in any number of colors, textures, finishes, and graphic patterns.

Hanging-cord 160 comprises corded material and is useful for suspending hanging-sunglass-holder-assembly 110 on planer surface 105 comprising a wall. In alternate embodiments hanging-cord 160 comprises jeweled braid, a length of leather, a length of silk ribbon, or other alternative suitable materials. Hanging-cord 160 is preferably flexible.

Hanging-cord-first-end 162 and hanging-cord-second-end 164 are threaded through pair of top-eyelets 126 and through pair of top-support-slat-eyelets 127 on top-support-slat 192 adjacent rear-side 140 of panel 115 and knotted behind top-support-slat 192 to secure hanging-cord 160 to panel 115. Top-support-slat 192 provides horizontal stabilization for top edge 116 of panel 115. Hanging-cord 160 is of sufficient length to be looped and be removably placed on a hanger-apparatus able to be used with planer surface 105. In an alternate embodiment, planer surface 105 may comprise a closet door with the hanger-apparatus 107 being placed on the top side of the closet door. Various hanging means may be used for the device itself and for sunglasses 109 held thereon. The present invention may be convenient for personal and/or commercial display and use.

Plurality of cross-cords 170, useful for suspending plurality of sunglasses 109 on panel 115, preferably comprise exactly six of cross-cords 170 with each of cross-cords 170 having cross-cord-first-end 172 and cross-cord-second-end 174. Each of cross-cords 170 comprises corded material of sufficient length to be threaded through each of cord-left-eyelets 130 and the horizontally opposing cord-right-eyelets 132, with each of cross-cord-first-end 130 and each of cross-cord-second-end 132 fixedly attached to rear-side 140 of panel 115. Each of cross-cords 170 is able to hold up to six pairs of sunglasses 109 suspended by a temple of sunglasses 109. In an alternate embodiment, plurality of cross-cords 170 comprises string material strong enough to hold up to six pairs of sunglasses 109. More or less sunglasses 109 may be stored on various embodiments.

Figure 3:
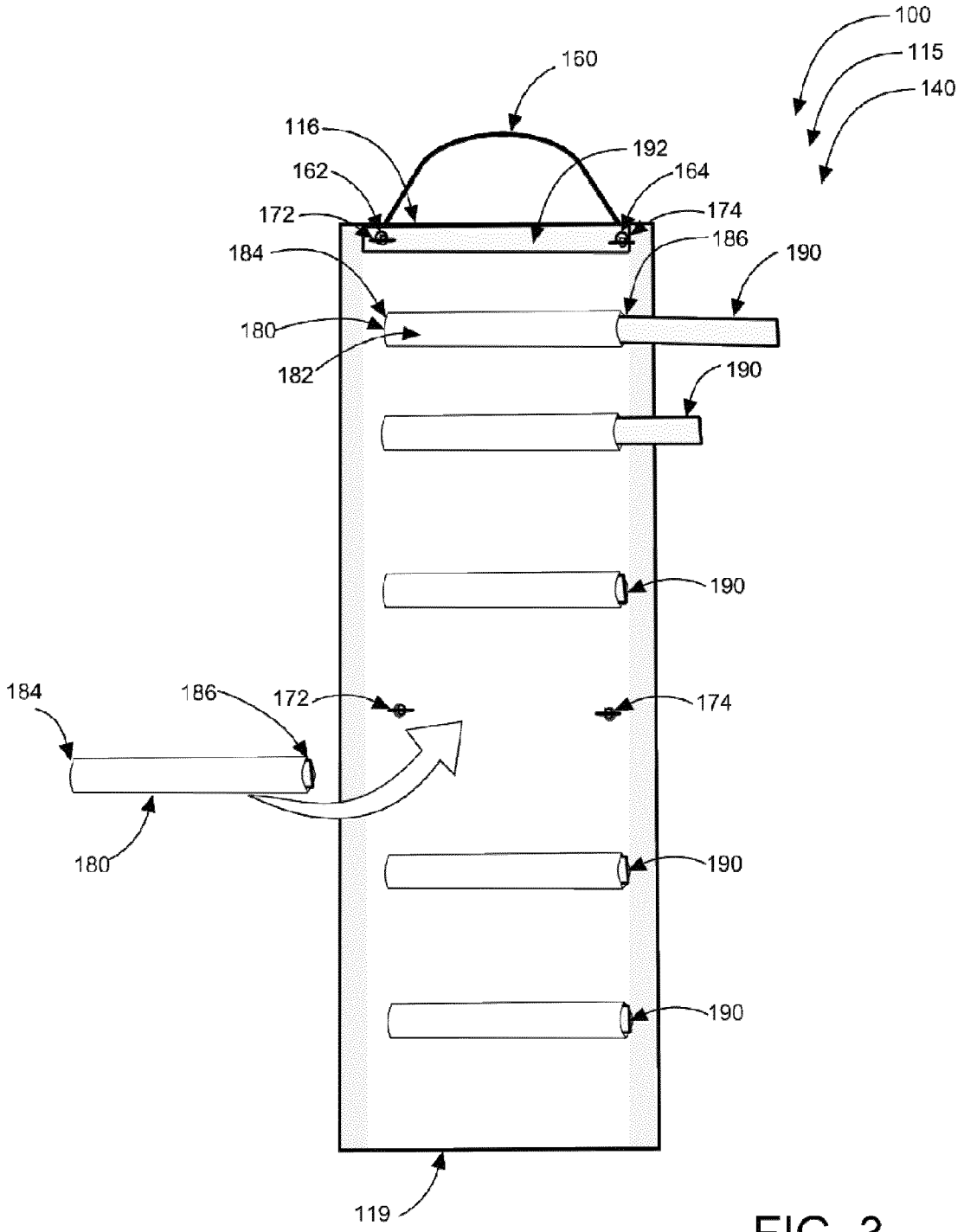
FIG. 3 is a perspective view illustrating a rear-side of panel according to an embodiment of the present invention of FIG. 1.

Referring now to FIG. 3, a perspective view illustrating rear-side 140 of panel 115 according to an embodiment of the present invention of FIG. 1.

Plurality of sheaths 180 may be comprised of fabric. Preferred embodiments, as shown, may comprise exactly six of sheaths 180, attached to rear-side 140 of panel 115 via stitching and a plurality of support-slats 190 comprising exactly six of support-slats 190. Each of plurality of sheaths 180 comprises sheath-volume 182, closed-end 184 and open-end 186. Each of plurality of sheaths 180 are horizontally aligned on rear-side 140 of panel 115 such that each of sheaths 180 is lined up with each of pair-of-cord-eyelets 128. Each of sheath-volumes 182 is comprised of fabric material of sufficient size to contain one of support-slats 190 comprising wooden material measuring about 11½ inches long, ½ inch high and deep. In an alternate embodiment, support-slats 190 may comprise a round rod of wooden material measuring about 11½ inches long and about ½ inch in diameter.

Support-slats 190 are inserted into sheaths 180 via open-end 186 to provide vertical and lateral support for panel 115. Closed-end 184 restricts support-slats 190 from slipping through sheaths 180 as they are inserted. Top-support-slat 192, placed adjacent top-edge 116 of rear-side 140 of panel 115 and held in place by knotting of hanging-cord-first-end 172 and knotting of hanging-cord-second-end 174, comprises wooden material measuring about 11½ inches long, ½ inch high and deep and is useful for horizontally supporting hanging-sunglass-holder-assembly 110 by holding panel 115 to its full width and height and prevents 'sagging' of hanging-sunglass-holder-assembly 110.

In alternative embodiments hanging-sunglass-holder-system 100 may comprise a variety of widths and heights in which case the number of pair of top-eyelets 126, the number and length of plurality of cross-cords 170, the number and length of plurality of sheaths 180, and the number and length of plurality of support-slats 190 may be adjusted accordingly.

Figure 4A:
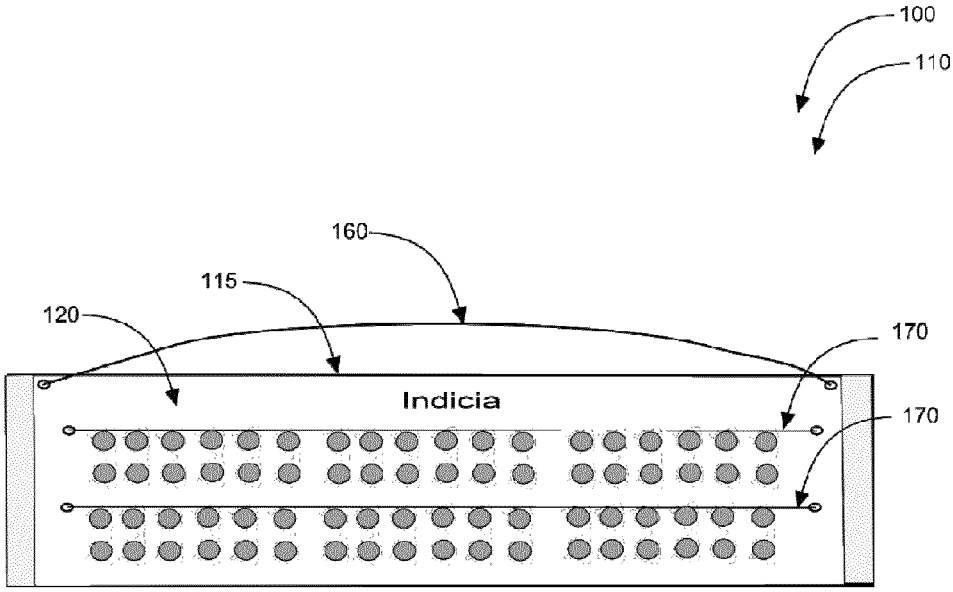
FIGS. 4A-4C are perspective views illustrating a horizontal embodiment of the hanging sunglass holder system according to an embodiment of the present invention of FIG. 1.
Figure 4B:
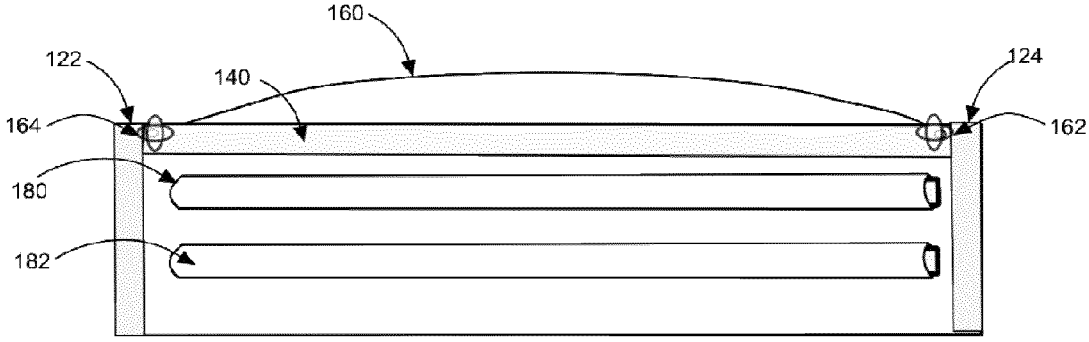
Figure 4C:
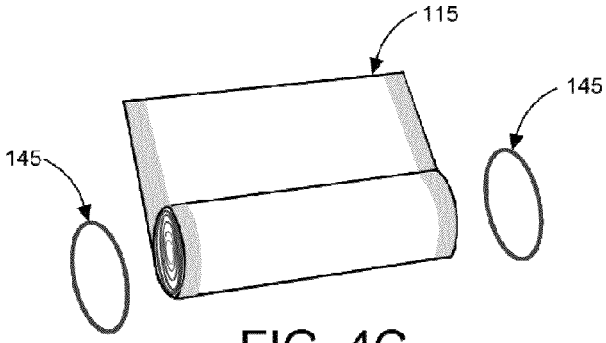

Referring now to FIG. 4A-4C, perspective views illustrating horizontal hanging sunglass holder system 100 according to another embodiment of the present invention of FIG. 1.

FIG. 4A illustrates a front view of a horizontal embodiment of hanging sunglass holder system 100 comprising all of the features included in the preferred embodiment. Panel 115 comprises a width of about 41½ inches and a height of about 11½ inches. Plurality of cross-cords 170, comprises exactly two of plurality of cross-cords 170, each of cross-cords 170 having cross-cord-first-end 172 and cross-cord-first-end 174. Each of cross-cords 170 is of sufficient length to hold eighteen pair of sunglasses 109. Alternate embodiments provide panel 115 of various widths and heights.

FIG. 4B illustrates a rear view of a horizontal embodiment of hanging sunglass holder system 100. Plurality of sheaths 180 fixedly attached to rear-side 140 of panel 115 comprises exactly two of plurality of sheaths 180 extending from left-trim 122 to right-trim 124. Plurality of support-slats 190 comprises exactly two of plurality of support-slats 190 with a length to fit within each of plurality of sheaths 180. Top-support-slat 192 extends from left-trim 122 to right-trim 124.

FIG. 4C illustrates hanging sunglass holder system 100 rolled up when not in use. The preferred embodiment of hanging sunglass holder system 100 and the horizontal embodiment of hanging sunglass holder system 100 may be rolled up for storage. The user has the option of leaving hanging-cord 160 and plurality of support-slats 190 in place or removing them. The user is able to roll hanging-sunglass-holder-assembly 110 from the top or from the bottom and secure the rolled up hanging-sunglass-holder-assembly 110 with a pair of elastic-bands 145. Other means of securement for the rolled up hanging-sunglass-holder-assembly 110 may also be used.

Figure 5A:
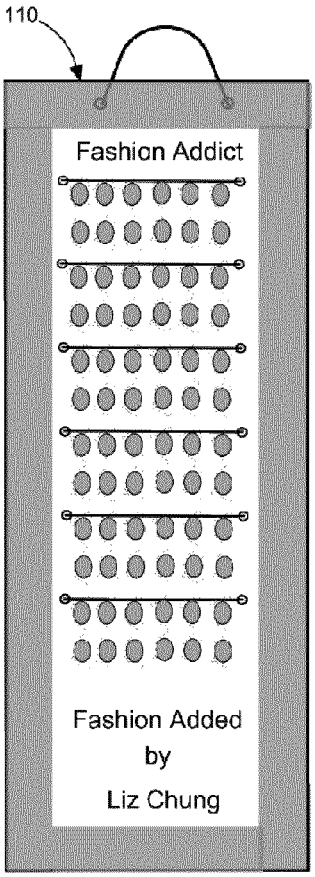
FIGS. 5A-5C are perspective views illustrating various alternate embodiments of a hanging sunglass holder system according to an embodiment of the present invention of FIG. 1.
Figure 5B:
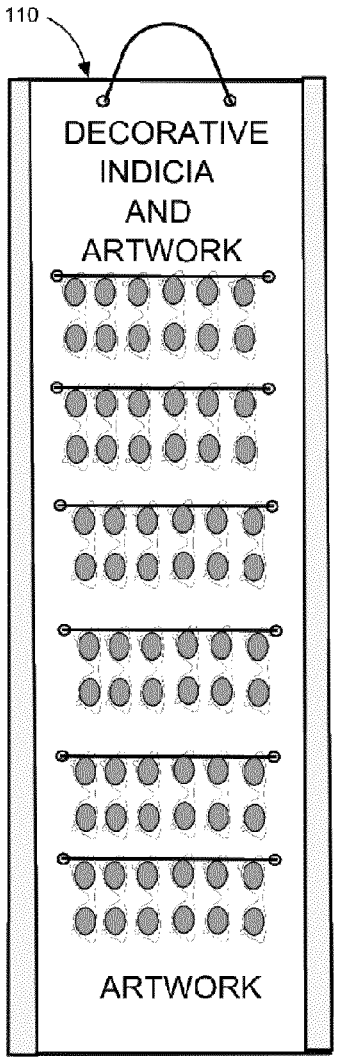
Figure 5C:
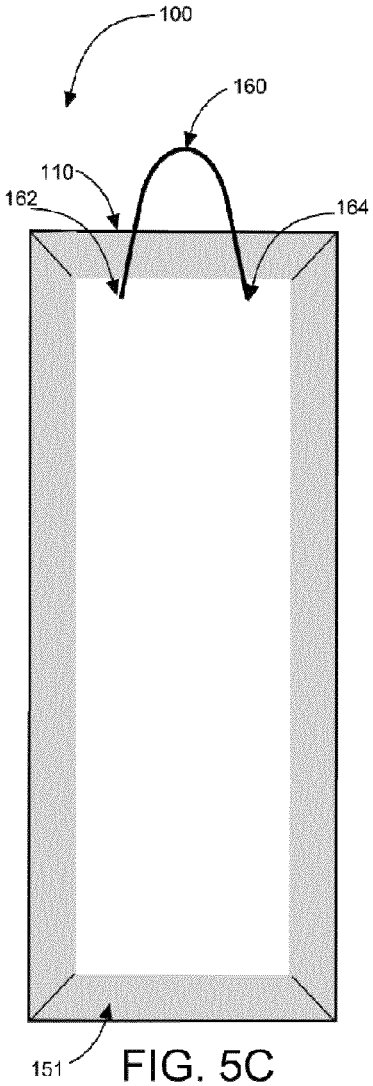

Referring now to FIG. 5A-5C, perspective views illustrating various alternate embodiments of hanging sunglass holder system 100 according to an embodiment of the present invention of FIG. 1.

FIG. 5A illustrates hanging sunglass holder system 100 comprising border 151 around the circumference of front-side 120 of panel 115. Border 151 is fixedly attached to front-side 120 via stitching, comprising fabric material (preferably) selected from the group consisting of silk, satin, and patterns. Border 151 may also include artwork, designs, and indicia to personalize hanging sunglass holder system 100 for the user. Features of the preferred embodiment included are panel 115 having front-side 120 and rear-side 140, hanging-cord 160 having hanging-cord-first-end 162 and hanging-cord-second-end 164, pair of top-eyelets 128, plurality of cross-cords 170, each of cross-cords 170 having cross-cord-first-end 172 and cross-cord-second-end 174, plurality of pair-of-cord-eyelets 128, plurality of sheaths 180 fixedly attached to rear-side 140 of panel 115, each of sheaths 180 having sheath-volume 182, closed-end 184 and open-end 186, plurality of support-slats 190 and top-support-slat 192.

FIG. 5B illustrates a vertically 'longer' version of hanging sunglass holder system 100. All of the features of the preferred embodiment except the measurements of panel 115 are included in this embodiment. Panel 115 measures approximately 53 inches in height and approximately 11½ inches in width in this embodiment shown. The extra length at the top of front-side 115 is available for any combination of artwork, slogans, graphics, and other indicia. If desired, buttons may be added to top-edge 116 of front-side 120 of panel 115 and button-holes may be added to bottom-edge 119 of front-side 120 of panel 115 to facilitate folding hanging sunglass holder system 100 in half. Alternately, other means of securement such as hook-and-loop and snaps may be used to facilitate folding hanging sunglass holder system 100 in half.

Alternate embodiments of hanging sunglass holder system 100 include shorter versions of panel 115 and longer versions of panel 115 with a corresponding reduction in the number of plurality of cross-cords 170, plurality of sheaths 180 and plurality of support-slats 190.

FIG. 5C illustrates rear-side 140 of panel 115 comprising border 151 comprising cardboard around the circumference of rear-side 140 of panel 115. This embodiment comprises panel 115 having front-side 120 and rear-side 140, left-trim 122 and right-trim 124 on front-side 120 of panel 115, hanging-cord 160 having hanging-cord-first-end 162 and hanging-cord-second-end 164, and plurality of cross-cords 170.

The cardboard is about 2 inches wide and provides vertical and horizontal support for hanging-sunglass-holder-assembly 100 thus eliminating the need for plurality of sheaths 180, plurality of support-slats 190 and top-support-slat 192.

Hanging-cord-first-end 162 and hanging-cord-second-end 164 are fixedly attached to rear-side 140 of panel 115 via glue eliminating the use of pair of top-eyelets 126. Alternatively, hanging-cord-first-end 162 and hanging-cord-second-end 164 are fixedly attached to rear-side 140 of panel 115 via stitching. Each of cross-cord-first-ends 162 and cross-cord-second-ends 164 are fixedly attached to front-side 120 of panel 115 via glue eliminating the use of plurality of pair-of-cord-eyelets 128. Alternately, each of cross-cord-first-ends 162 and cross-cord-second-ends 164 are fixedly attached to front-side 120 of panel 115 via stitching.

Figure 6:
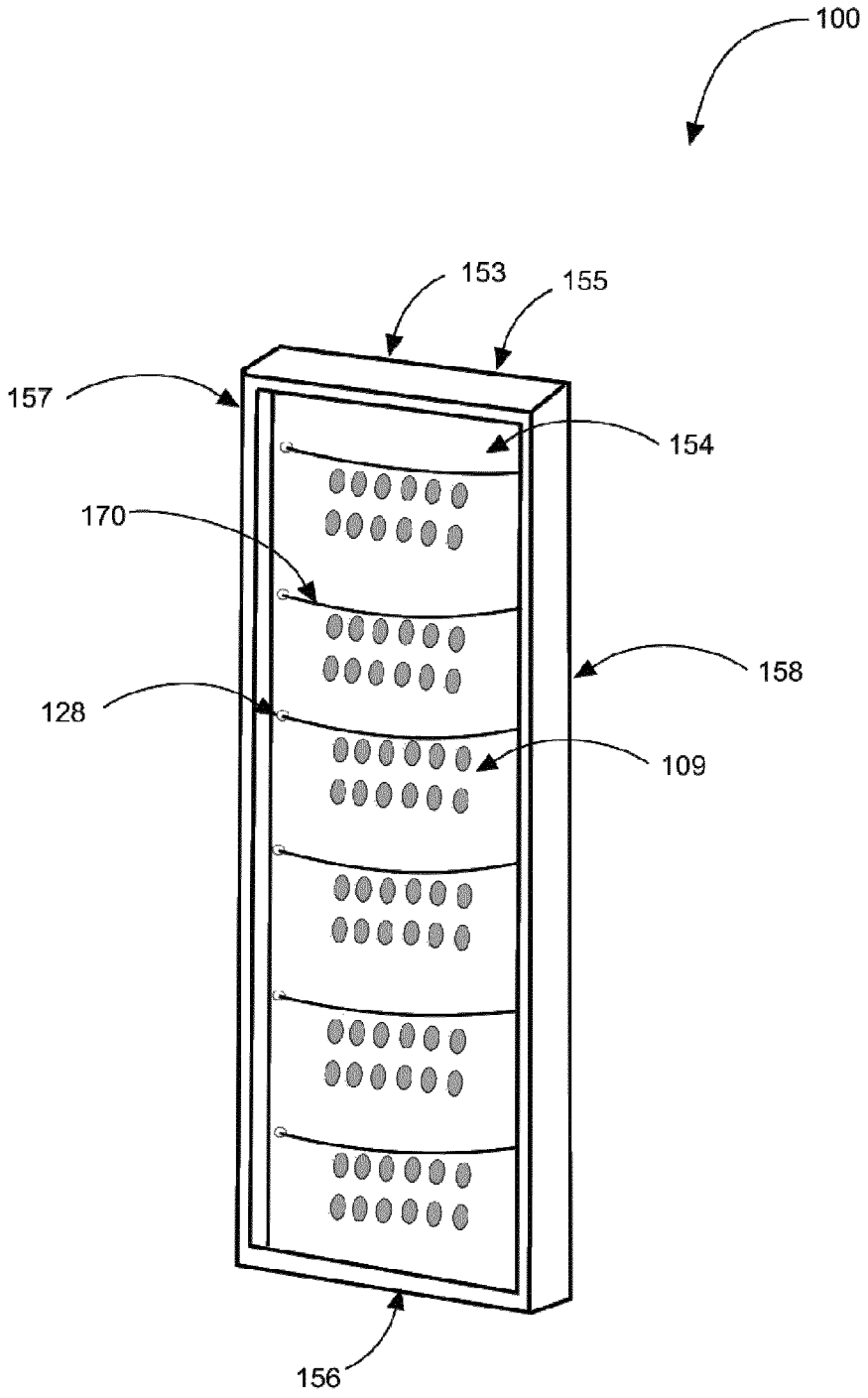
FIG. 6 is a perspective view illustrating a 3-dimensional hanging sunglass holder system according to an embodiment of the present invention of FIG. 1.

Referring now to FIG. 6, a perspective view illustrating 3-dimensional hanging sunglass holder system 100 according to another embodiment of the present invention of FIG. 1.

Hanging sunglass holder system 100 in an alternate embodiment comprises hanging-sunglass-holder-assembly 110 which comprises in combination 3-dimensional-frame 153, plurality of pair-of-cord-eyelets 128, and plurality of cross-cords 170.

3-dimensional-frame 153 comprises back 154, top-side 155, bottom-side 156, left-side 157, and right-side 158 creating a shadow-box affect. 3-dimensional-frame 153 comprises light-weight wood material providing vertical and lateral stabilization for 3-dimensional-frame 153. This particular embodiment allows for an inset of sunglasses 109 for 'extra protection' and a 'framed look'.

When in use, 3-dimensional-frame 153 sits on planer surface 105 comprising the top surface of a piece of furniture with bottom-side 156 being adjacent the top surface of the piece of furniture. 3-dimensional-frame 153 may comprise hanging-cord 160 having hanging-cord-first-end 162 and hanging-cord-second-end 164 such that 3-dimensional-frame 153 may be suspended from hanging-apparatus 107 on planer surface 105 comprising a wall.

Plurality of pair-of-cord-eyelets 128 comprises exactly six of pair-of-cord-eyelets 128 located on back 154. Each of pair-of-cord-eyelets 128 comprises cord-left-eyelet 130 and cord-right-eyelet 132 having a horizontal orientation to each other on back 154. Each of cord-left-eyelets 130 are located relatively close to inside-edge 123 of left-side 157 and each of cord-right-eyelets 132 are located relatively close to inside-edge 123 of right-side 158. Each of pair-of-cord-eyelets 128 are arranged with a vertical distance of about seven inches from each other.

Plurality of cross-cords 170 are useful for suspending plurality of sunglasses 109 on back 154 of 3-dimensional-frame 153. Each of plurality of cross-cords 170 comprises exactly six of cross-cords 170 and is of sufficient length such that each of cross-cord-first-ends 172 and each of cross-cord-second-ends 174 is able to be threaded through each of pair-of-cord-eyelets 128 and be fixedly attached to back 153 of 3-dimensional-frame 153 via stapling. In an alternate embodiment each of cross-cord-first-ends 172 and each of cross-cord-second-ends 174 on fixedly attached to back 153 via glue. Each of cross-cords 170 is able to hold up to six pairs of sunglasses 109 suspended by a temple of sunglasses 109. In an alternate embodiment, plurality of cross-cords 170 comprise string material strong enough to hold up to six pairs of sunglasses 109.

Hanging sunglass holder system 100 may be sold as kit 440 comprising the following parts: at least one panel 115 having front-side 120 and rear-side 140, left-trim 122, and right-trim 124, plurality of sheaths 180, pair of top-eyelets 126, and plurality of pair-of-cord-eyelets 128; at least one hanging-cord 160; at least six support-slats 190; at least one top-support-slat 192; at least six cross-cords 170; and at least one set of user instructions. The kit has instructions such that functional relationships are detailed in relation to the structure of the invention (such that the invention can be used, maintained, or the like in a preferred manner). Hanging sunglass holder system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color/design combinations, parts may be sold separately, etc., may be sufficient.

Figure 7:
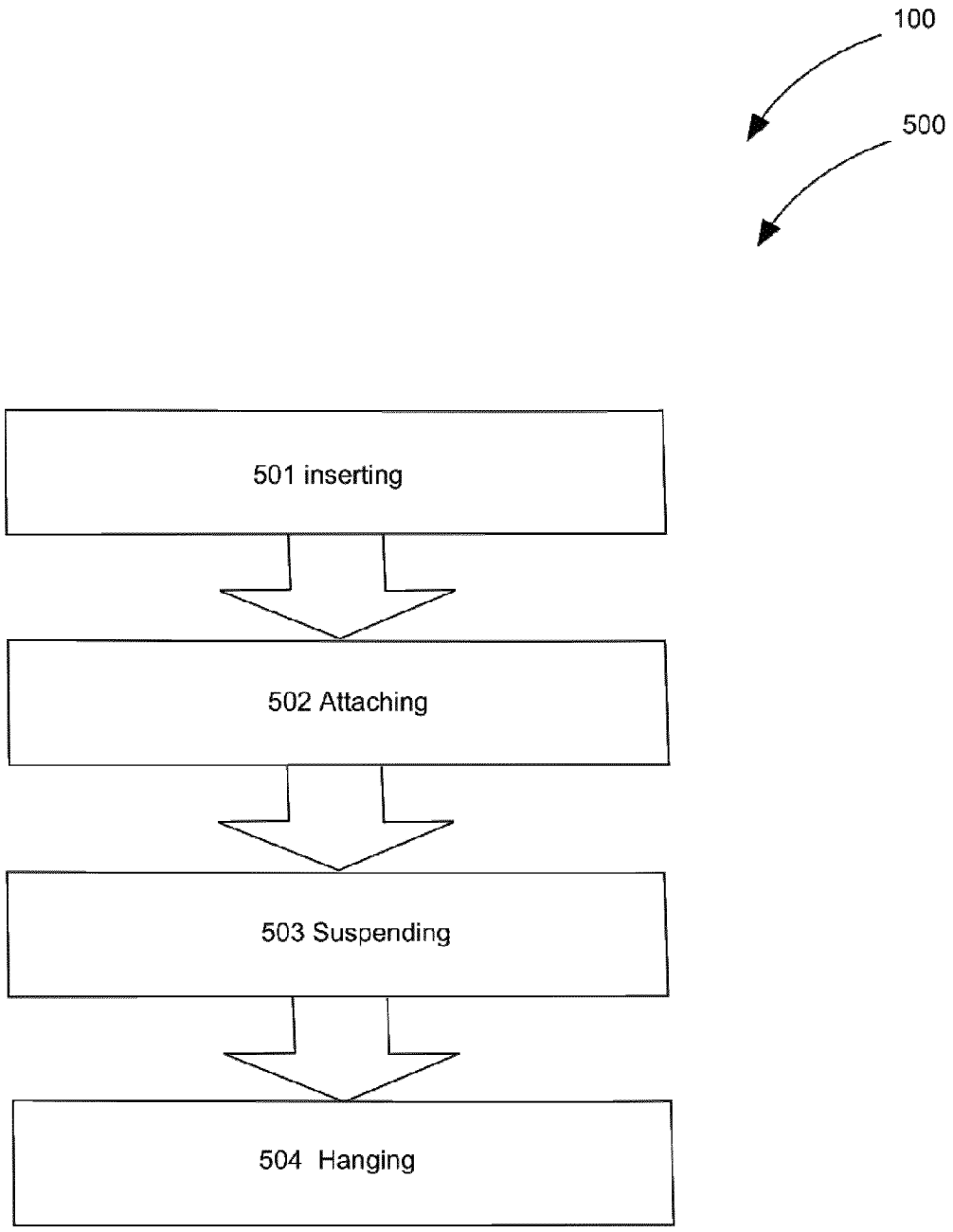
FIG. 7 is a flowchart illustrating a method of use for the hanging sunglass holder system according to an embodiment of the present invention of FIGS. 1-6.

Referring now to FIG. 7, a flowchart illustrating a method of use 500 for hanging sunglass holder system 100 according to an embodiment of the present invention of FIGS. 1-6.

Method of use 500 for hanging sunglass holder system 100 preferably comprises the steps of: step one 501 inserting plurality of support-slats 190 into plurality of sheaths 180 via open-end 186 of each sheath 180; step two 502 attaching hanging-cord 160; step three 503 suspending hanging sunglass holder system 100 on planer surface 105 via placing hanging-cord 160 on hanging-apparatus 107; and step 504 hanging plurality of sunglasses 109 on each of cross-cords 170 as desired.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hanging sunglass holder system comprising:

a hanging-sunglass-holder-assembly comprising;

a panel having a front-side and a rear-side, each of said front-side and said rear-side having a left-trim, a right-trim, a pair of top-eyelets, and a plurality of pair-of-cord-eyelets;

a hanging-cord having a hanging-cord-first-end and a hanging-cord-second-end;

a plurality of cross-cords, each of said cross-cords having a cross-cord-first-end and a cross-cord-second-end;

a plurality of sheaths fixedly attached to said rear-side, each of said sheaths having a sheath-volume, a closed-end and an open-end; and a plurality of support-slats;

wherein said hanging-cord having said hanging-cord-first-end and said hanging-cord-second-end is adapted to suspend said hanging-sunglass-holder-assembly on a planer surface;

wherein each of said cross-cords is adapted to suspend a plurality of sunglasses;

wherein said plurality of sheaths fixedly attached to said rear-side are adapted to suspend said plurality of support-slats; and wherein a user is able to insert said plurality of support-slats into said plurality of sheaths via said open-end of each said sheath, attach said hanging-cord and removably suspend said hanging-sunglass-holder-assembly on a planer surface via said hanging-cord placed upon a hanging-apparatus, and then place a plurality of sunglasses on each of said cross-cords as desired.

2. The hanging sunglass holder system of claim 1 wherein said panel comprises fabric material approximately 41½ inches in height and approximately 11½ inches in width.

3. The hanging sunglass holder system of claim 2 wherein said left-trim and said right trim are fixedly attached to said front-side and said rear-side of said panel.

4. The hanging sunglass holder system of claim 3 wherein said left-trim and said right trim are located on a left-edge and a right-edge of said panel in a vertical alignment.

5. The hanging sunglass holder system of claim 1 wherein said pair of top-eyelets are located adjacent to a top-edge of said panel and each of said pair of top-eyelets are located an equal distance from said left-trim and said right-time with said pair of top-eyelets having a horizontal alignment.

6. The hanging sunglass holder system of claim 1 wherein said hanging-cord includes a hanging-cord-first-end; and said hanging-cord-second-end comprises a cord of sufficient length to be removably placed on a hanger-apparatus.

7. The hanging sunglass holder system of claim 1 wherein said plurality of pair-of-cord-eyelets comprises exactly six of said pair-of-cord-eyelets, each of said pair-of-cord-eyelets comprising a cord-left-eyelet and a cord-right-eyelet.

8. The hanging sunglass holder system of claim 7 wherein each of said pair-of-cord-eyelets comprises a horizontal orientation on said panel, each of said pair-of-cord-eyelets located adjacent to an inside-edge of said left-trim and said right-trim, and each of said pair-of-cord-eyelets arranged with a distance of about seven inches from each other.

9. The hanging sunglass holder system of claim 1 wherein said plurality of cross-cords comprises exactly six of said cross-cords of sufficient length to be threaded through each of said cord-left-eyelets and said cord-right-eyelets.

10. The hanging sunglass holder system of claim 9 wherein each of said cross-cord-first-end is threaded through each of said cord-left-eyelets and fixedly attached to said rear-side of said panel and cross-cord-second-end is threaded through each of opposing said cord-right-eyelets and fixedly attached to said rear-side of said panel, each of said plurality of cross-cords said length able to hold up to six pairs of sunglasses suspended by a temple of said sunglasses.

11. The hanging sunglass holder system of claim 1 wherein each of said plurality of sheaths are horizontally aligned on said rear-side of said panel such that each of said sheaths is lined up with each of said pair-of-cord-eyelets.

12. The hanging sunglass holder system of claim 11 wherein each of said support-slats is formed from a wooden material measuring and measures about 11½ inches long, and ½ inch high and deep, and wherein said support-slats are adapted to provide vertical and lateral support for said panel.

* * * * *